US006025824A

United States Patent [19]

Horiuchi et al.

[11] Patent Number: 6,025,824

[45] Date of Patent: Feb. 15, 2000

[54] PIEZOELECTRIC TRANSFORMER DRIVING CIRCUIT AND COLD CATHODE TUBE ILLUMINATING DEVICE USING THE SAME

[75] Inventors: Sachito Horiuchi; Eiji Nakagawa; Masanori Fujisawa, all of Kyoto; Shingo Kawashima, Tokyo, all of Japan

[73] Assignees: Rohm Co., Ltd., Kyoto; NEC Corporation, Tokyo, both of Japan

[21] Appl. No.: 08/989,411

[22] Filed: Dec. 12, 1997

[30] Foreign Application Priority Data

Dec. 17, 1996 [JP] Japan ..... 8-353591

[51] Int. Cl.[7] ..... G09G 3/36

[52] U.S. Cl. ..... 345/102; 345/211; 315/276; 310/311

[58] Field of Search ..... 345/102, 211, 345/212, 74, 75, 61, 69, 70; 315/276, 278, 282, 291, 307; 363/15, 16, 20, 21, 95, 97, 99, 131; 323/301, 299; 310/311, 314, 318

[56] References Cited

U.S. PATENT DOCUMENTS 5,078,476 1/1992 Shin ..... 345/212
5,726,536 3/1998 Hagiwara ..... 345/102
5,739,679 4/1998 Takehara ..... 323/299
5,818,709 10/1998 Takehara ..... 363/95
5,844,540 12/1998 Terasaki ..... 345/102
5,905,491 5/1999 Kim ..... 345/212
5,936,598 8/1999 Hayama et al. ..... 345/212

*Primary Examiner*—Regina Liang
*Attorney, Agent, or Firm*—Beall Law Offices

[57] ABSTRACT

A piezo electric transformer driving circuit and a cold cathode tube illuminating device comprising a series circuit including a switch circuit, a coil and a switching transistor and being connected successively in the named order between a power source line and a ground; a piezo electric transformer of which primary side electrode is connected to a juncture of the coil and the switching transistor; and a drive halting circuit which geneates a first control signal for turning OFF the switching circuit and further generates a second control signal for halting a switching operation of the switching transistor after a predetermined period from the generation of the first control signal, wherein the predetermined period is at least one turned ON interval of the switching transistor and through the switching operation of the switching transistor a high voltage is generated at a secondary side of the piezo electric transformer.

10 Claims, 4 Drawing Sheets

PIEZOELECTRIC TRANSFORMER DRIVING CIRCUIT AND COLD CATHODE TUBE ILLUMINATING DEVICE USING THE SAME

BACKGROUND OF THE INVENTION

1. Field of the Invention

The present invention relates to a piezo electric transformer driving circuit and a cold cathode tube illuminating device using the same, and, more specifically, relates to a piezo electric transformer driving circuit in a driving circuit of a cold cathode tube used as a back light for a liquid crystal displaydevice which, when obtaining an electric power of a high step-up voltage necessary for driving the cold cathode tube through driving a piezo electric transformer, permits the high voltage step-up through driving the piezo electric transformer without necessitating a transistor having a high dielectric break down voltage and hardly breaks the driving transistor.

2. Background Art

Conventionally, a cold cathode tube has been generally used as a back light disposed at the back side of a liquid crystal member in a liquid crystal display device. A light-on voltage of a cold cathode tube is high, for example, more than 1000 V and such a high voltage is obtained by stepping up a voltage of about 5~6 V. For this purpose a lighting-on circuit therefor uses an inverter circuit, and because of circuit size reduction demand in these days an inverter circuit making use of a piezo electric transformer is currently being used instead of an electro magnetic type inverter circuit.

FIG. 3 is such a cold cathode tube illuminating device making use of a piezo electric transformer.

Numeral 10 generally designates the cold cathode tube illuminating device and numeral 1 is a control circuit therefor, 5 is a piezo electric transformer driving circuit therefor, 6 is a piezo electric transformer and 7 is a cold cathode tube, in that a cold cathode fluorecent lamp. The control circuit 1 is constituted by a pulse oscillation circuit 2, a flip-flop circuit (FF) 3 and buffer amplifier 4*a* and 4*b* which receive outputs from the flip-flop circuit 3. A Q output and an inverted side output (Q output, hereinbelow called as Q bar output) generated with the Q output of the flip-flop circuit (FF) 3 are respectively applied via the buffer amplifiers 4*a* and 4*b* to the piezo electric transformer driving circuit 5. Further, the control circuit 1 is provided with a drive halting circuit 8. When a manipulation switch SW such as a power source switch, a switch for halting the driving circuit or a light-off switch for a liquid crystal back light is shifted from ON to OFF, the drive halting circuit 8 generates a light halting signal S (or a light-off signal S) for halting lighting of the cold cathode tube 7 in response to the OFF signal and applies the signal to the flip-flop circuit 3 to halt the operation thereof.

In the above example, the primary side of the piezo electric transformer 6 is driven via two circuit line systems which are driven alternatively and provides a doubled driving signal to the primary side thereof to thereby produce a high voltage sinusoidal or the like signal at the secondary side thereof. In this instance a driving voltage frequency from several tens kHz to several handreds kHz is used for the piezo electric transformer 6.

The piezo electric transformer driving circuit 5 is constituted by a first switching circuit 51 and a second switching circuit 52 both are provided between a power source line $V_{DD}$ and a grounding line GND. The first switching circuit

51 is constituted by a series circuit including a coil L1 provided at the side of the power source $V_{DD}$ and an N channel MOSFET transistor Q1 of which drain side is connected to the coil L1 and of which source side is grounded. An output P1 of the transistor Q1 appears at the juncture between the drain of the transistor Q1 and the coil L1 and is connected to a primary side electrode 61 of the piezo electric transformer 6. The gate of the transistor Q1 is connected to receive the Q bar output Pc of the flip-flop circuit 3 via the buffer ampifier 4*a*.

The second switching circuit 52 is constituted by another series circuit including a coil L2 provided at the side of the power source $V_{DD}$ and an N channel MOSFET transistor Q2 of which drain side is connected to the coil L2 and of which source side is grounded. An output P2 of the transistor Q2 appears at the juncture between the drain of the transistor Q2 and the coil L2 and is connected to a primary side electrode 62 of the piezo electric transformer 6. The gate of the transistor Q2 is connected to receive the Q output Pb of the flip-flop circuit 3 via the buffer amplifier 4*b*.

In the above explained circuit the coils L1 and L2 are inserted in series with the piezo electric transformer 6. The reason of employing such circuit structure is to efficiently utilize a voltage oscillation by the piezo electric transformer 6 determined depending on the capacitive component of the piezo electric transformer 6 and the inductance component of the coils. Accordingly, the inductance values of the coils L1 and L2 are respectively selected in view of the capacitive component of the piezo electric transformer 6 so as to resonate with the frequency of the driving signal, thereby the conversion efficiency of the circuit is increased.

The cold cathode tube 7 is connected through one electrode thereof to a secondary side electrode 63 of the piezo electric transformer 6 and the other electrode thereof is connected to the ground GND via a parallel circuit of a resistor R and a diode D.

Further, the control circuit 1 includes a further control circuit which detects the voltage of the resistor R and operates to keep the oscillation frequency of the pulse oscillation circuit 2 at a constant frequency, however, such further control circuit does not relates directly to the present invention, therefore the illustration and explanation thereof is omitted.

The driving and halting operation of the above explained circuit is explained with reference to waveform diagrams illustrated in FIGS. 4(*a*)–4(*f*). At first, the flip-flop circuit 3 receives a pulse signal Pa as illustrated in FIG. 4(*a*) from the pulse oscillation circuit 2 and outputs as the Q output the pulse signal Pb as illustrated in FIG. 4(*b*) which is formed by dividing the pulse signal Pa by ½. At the same time the flip-flop circuit 3 also generates the pulse signal Pc as illustrated in FIG. 4(*c*) which is an inversion of the Q output as a Q bar output. In response to the respective outputs the respective transistors Q1 and Q2 are turned ON and generate respective signals as illustrated in FIGS. 4(*e*) and 4(*f*) as the outputs P1 and P2 and apply the same to the primary sides of the piezo electric transformer 6. As a result, a high voltage sinusoidal or the like signal is obtained at the secondary side of the piezo electric transformer 6.

When halting lighting of the cold cathode tube 7 under the above explained driving condition, the output of the flip-flop circuit 3 is halted which is located at a pre-stage of the piezo electric transformer driving circuit 5. For example, when a light halting signal S is generated from the drive halting circuit 8 at a time point t1 as illustrated in FIG. 4(*d*) and the output of the flip-flop circuit 3 is halted, high voltage fly back pulses F1 and F2 are generated at the outputs P1 and P2 of the transistors Q1 and Q2, because any discharge routes of energy accumulated in the coils L1 and L2 are lost.

In the above explained piezo electric transformer driving circuit 5, for the transistors Q1 and Q2 performing the switching operation transistors having a higher electric break down voltage than that of the fly back pulses F1 and F2 are used so as to withstand the fly back pulse voltage. For this reason, the transistors to be employed have to have a very high withstand. Moreover, since these transistors suffer from such a high voltage fly back pulses F1 and F2, the transistors are still endangered to be broken down.

SUMMARY OF THE INVENTION

An object of the present invention is to provide a piezo electric transformer driving circuit which permits driving of a piezo electric transformer without necessitating use of a transistor havin a high withstand voltage and hardly breaks the driving transistor.

Another object of the present invention is to provide an inexpensive cold cathode tube illuminating device which hardly breaks a driving transistor included therein.

A piezo electric transformer driving circuit and a cold cathode tube illuminating device according to the present invention which achieve the above objects are characterized in that, the piezo electric transformer driving circuit and the cold cathode tube illuminating device comprise a series circuit including a switch circuit, a coil and a switching transistor and being connected successively in the named order between a power source line and a ground; a piezo electric transformer of which primary side electrode is connected to a juncture of the coil and the switching transistor; and a drive halting circuit which geneates a first control signal for turning OFF the switch circuit and further generates a second control signal for halting a switching operation of the switching transistor after a predetermined period from the generation of the first control signal, wherein the predetermined period is at least one turned ON interval of the switching transistor and through the switching operation of the switching transistor a high voltage is generated at a secondary side of the piezo electric transformer.

Namely, prior to the coil which receives an electric power from the power source line the switch circuit is disposed and the switch circuit is for the first time turned OFF for halting the piezo electric transformer driving circuit. Subsequently, after the predetermined period corresponding to at least one turned ON interval or more than one time of the respective switching transistors, the switching operation of the switching transistors is halted by the drive halting circuit.

Thereby, electric energy accumulated in the coils is flown to the ground GND during the predetermined period and the accumulated electric energy substantially disappears, therefore, substantially no fly back pulses are generated when the driving of the piezo electric transformer is halted.

As a result, no high fly back pulse voltages are applied on the switching transistor, therefore, a transistor having a low withstand voltage can be used for the switching transistor. Further, a possible break down of the switching transistor is prevented.

DESCRIPTION OF THE PREFERRED EMBODIMENT

Figure 1:
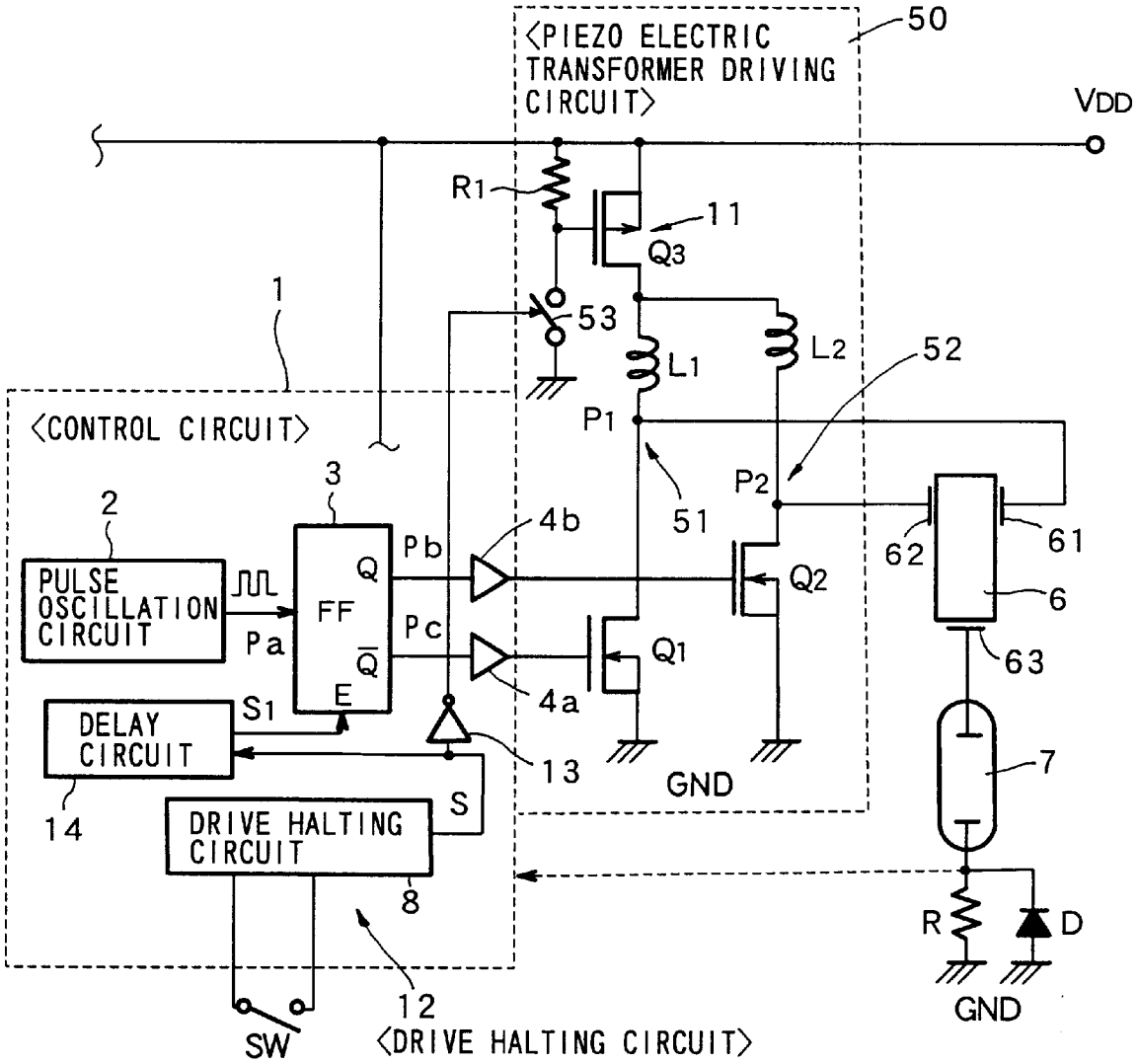
FIG. 1 is a block diagram of one embodiment of cold cathode tube illuminating devices to which a piezo electric transformer driving circuit according to the present invention is applied.
Figure 3:
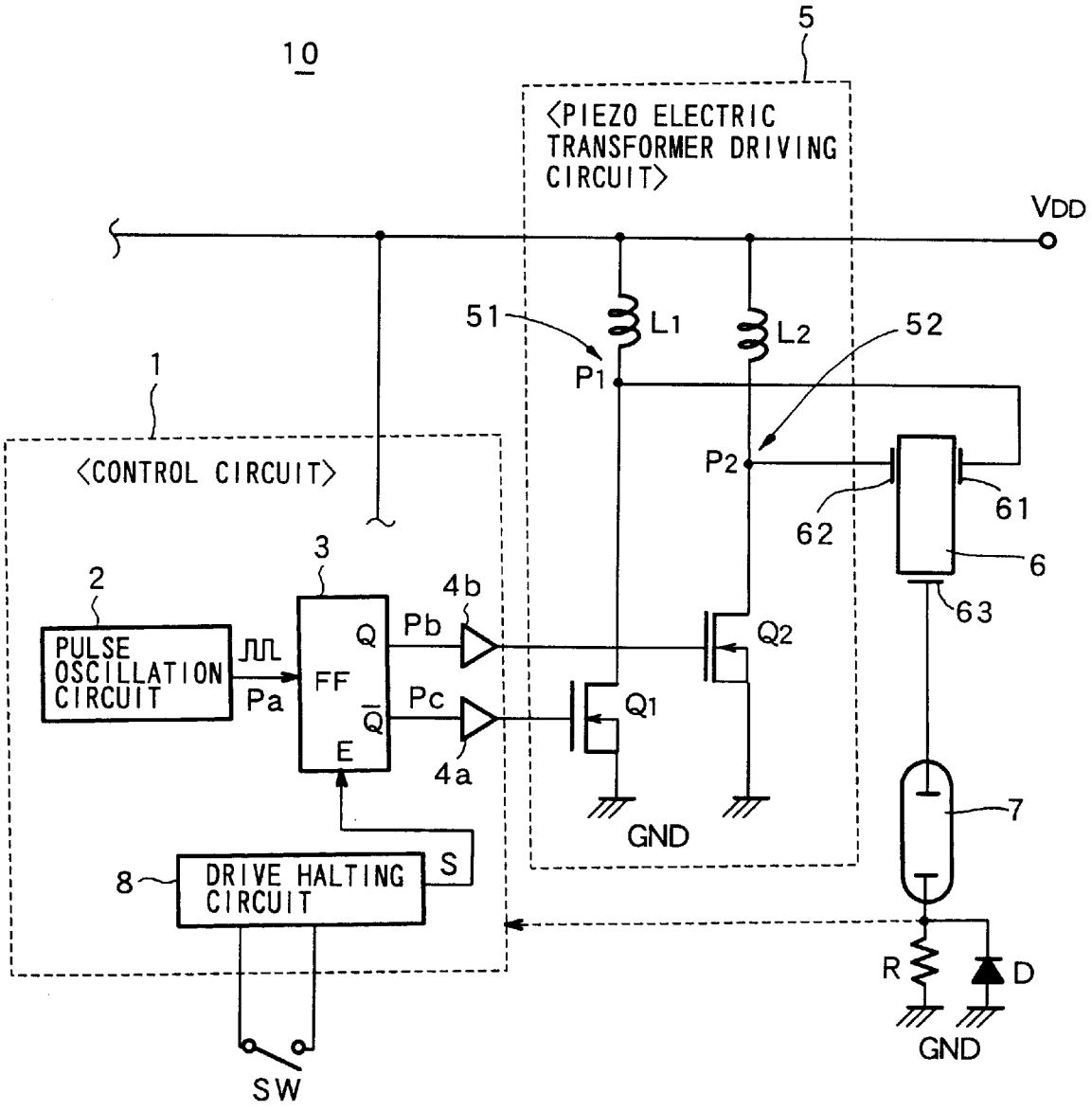
FIG. 3 is a block diagram of a cold cathode tube illumination device using a conventional piezo electric transformer driving circuit.

Differences of the cold cathode tube illuminating device shown in FIG. 1 from that shown in FIG. 3 are that a switch circuit 11 is provided between the power source line $V_{DD}$ and the coils L1 and L2, and the drive halting circuit 8 in the control circuit 1 shown in FIG. 3 is replaced by a modified drive halting circuit 12 including the corresponding drive halting circuit 8, an inverter 13 and a delay circuit 14.

The switch circuit 11 is constituted by a P channel MOSFET transistor Q3 of which source side is connected to the power source line $V_{DD}$ and of which drain side is connected in common to the coils L1 and L2, a bias resistor R1 which is inserted between the gate of the transistor Q3 and the power source line $V_{DD}$ and a switch circuit 53 for grounding the gate of the transistor Q3, and when the switch circuit 53 receives an inverted signal of a light-on halting signal S from the drive halting circuit 12 and pulls up the gate of the transistor Q3 to the voltage $V_{DD}$, the transistor Q3 is turned OFF.

As explained previously, the drive halting circuit 12 is constituted by the drive halting circuit 8, the inverter 13 and the delay circuit 14, and when a manipulation switch SW such as a power source switch, a switch for halting the driving circuit or a light-off switch for a back light is shifted from ON to OFF, the drive halting circuit 8 which receives the OFF signal generates the light-on halting signal S. A HIGH level (hereinbelow referred to as "H") significant signal of the light-on halting signal S is inverted to LOW level (hereinbelow referred to as "L") signal via the inverter 13 and turns OFF the switch circuit 53 to thereby turn OFF the transistor Q3. Further, by delaying the light-on halting signal S via the delay circuit 14 a signal S1 is generated and is applied to the flip-flop circuit 3 to halt the operation thereof, which is performed by disabling the enable terminal E thereof with "H" signal. In this instance, the delay time by the delay circuit 14 is at a timing after the switching transistors Q1 and Q2 are turned ON more than once.

Figure 2:
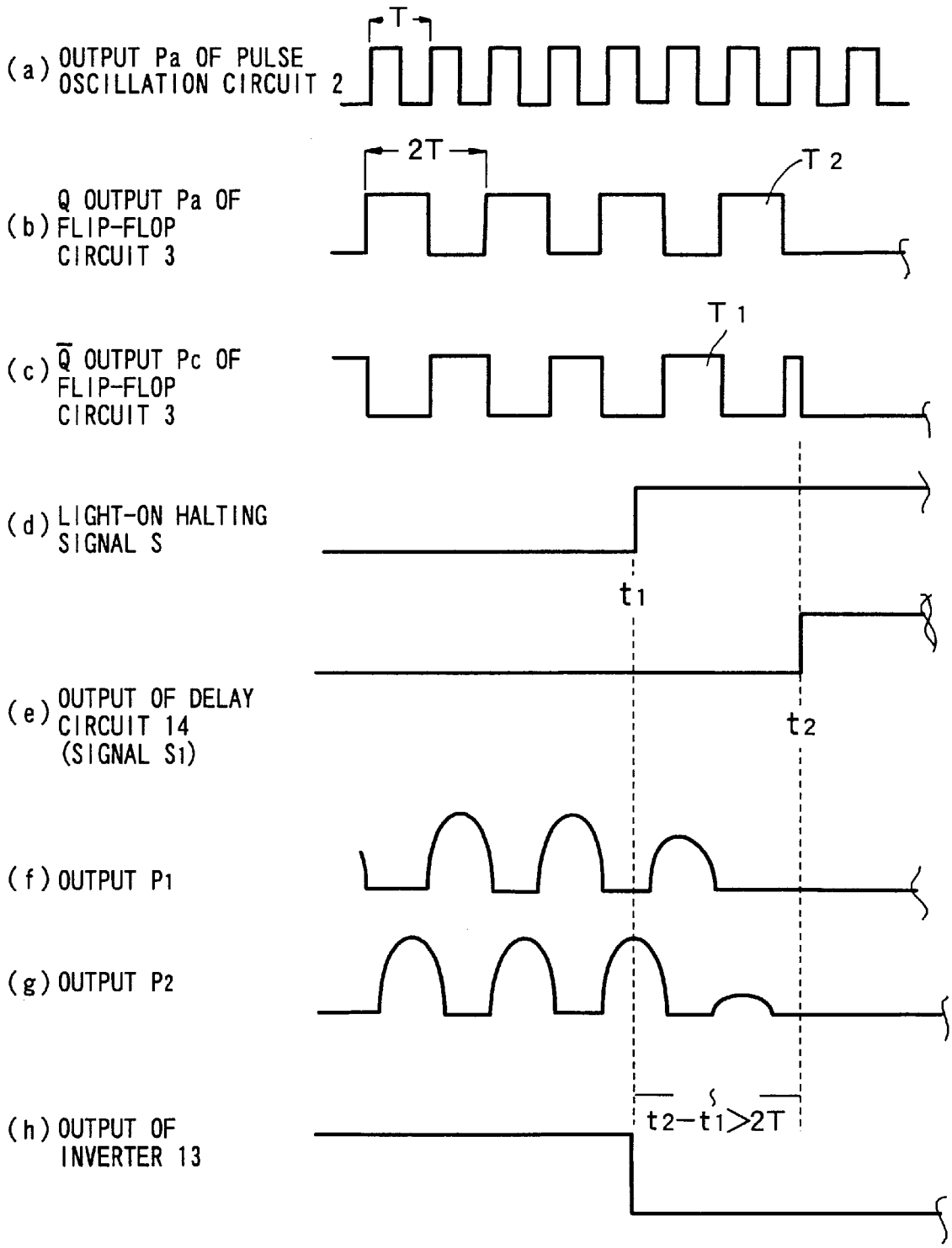
FIGS. 2(*a*)–2(*h*) are a time chart showing the operation of the embodiment.
Figure 4:
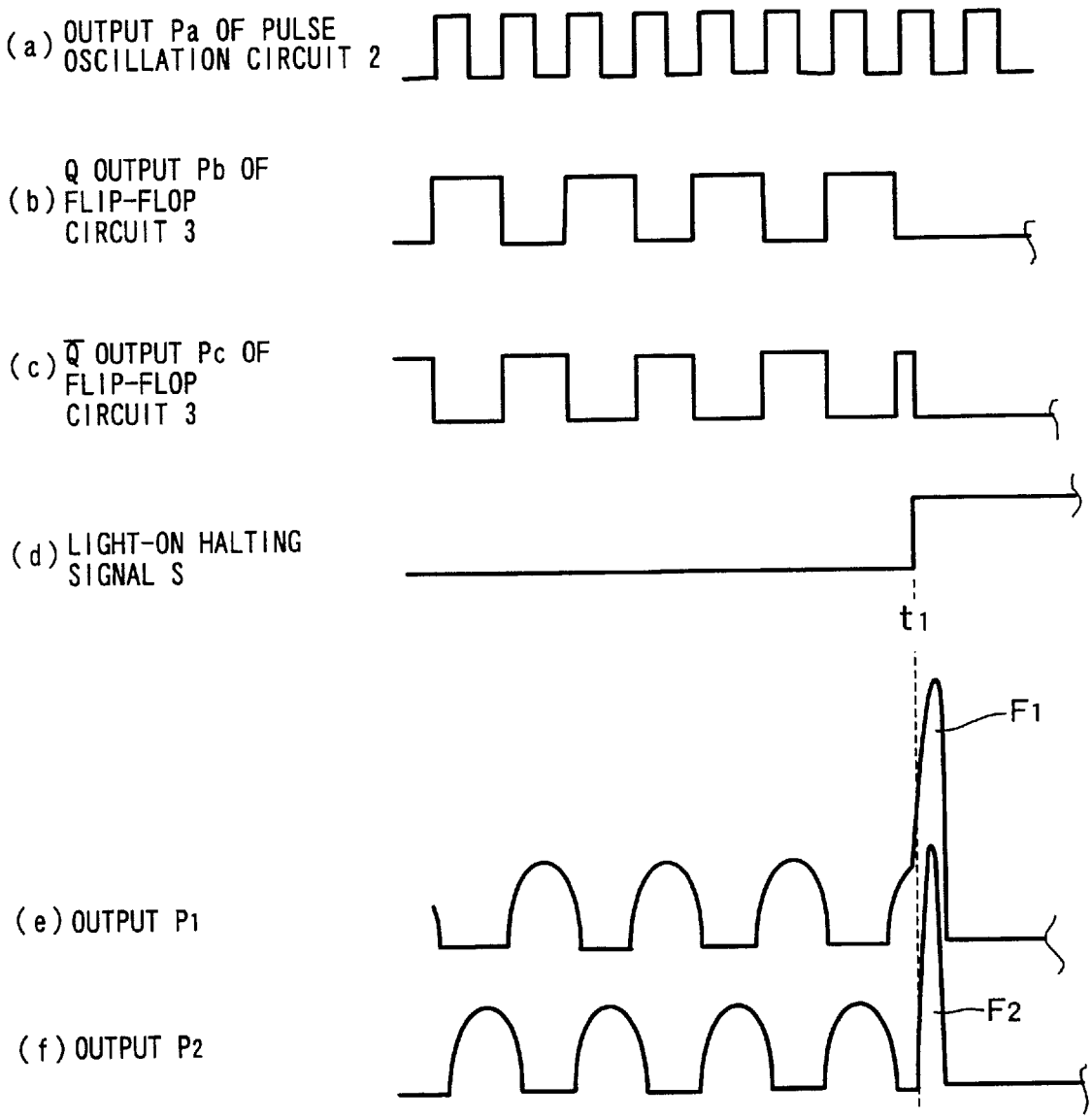
FIGS. 4(*a*)–4(*f*) are a time chart showing the operation of the device shown in FIG. 3.

Namely, when assuming the cycle period of the pulse oscillation circuit 2 as T, the delay period is 2; a period more than 2T (see FIG. 2(*g*)). The driving and halting operation of the circuit according to the present embodiment is explained with reference to the waveform diagrams shown in FIGS. 2(*a*)–2(*h*). At first, the flip-flop circuit 3 receives a pulse signal Pa as illustrated in FIG. 2(*a*) from the pulse oscillation circuit 2 and outputs a pulse signals Pb and Pc as illustrated in FIGS. 2(*b*) and 2(*c*) as the Q output and the Q bar output respectively which are formed by dividing the pulse signal Pa by ½. In response to the respective outputs the respective transistors Q1 and Q2 are turned ON and generate respective signals as illustrated in FIGS. 2(*f*) and 2(*g*) as the outputs P1 and P2. The operation up to this is substantially the same as that explained in connection with FIGS. 3 and 4.

Under such driving condition, for example, when the manipulation switch SW is shifted from ON to OFF at a time point t1 as illustrated in FIG. 2(*d*), and a light-on halting signal S is generated from the drive halting circuit 8, for the first time, the transistor Q3 is turned OFF. Thereby, a current from the power source $V_{DD}$ flowing through the coils L1 and L2 is interrupted. Subsequently, the electric energy accumulated in the coil L1 is sinked to the ground GND during the ON period T1 of the switching transistor Q1, and the electric energy accumulated in the coil L2 is sinked to the ground GND during the ON period T2 of the switching transistor Q2.

As a result, at a timing t2 when a signal S1 (a light-on halting signal) representing an output of the delay circuit 14 is generated, almost all the electric energy accumulated in the coils L1 and L2 disappears. Therefore, at this instance substantially no fly back pulses are generated. Further, when assuming the pulse cycle period from the pulse oscillation circuit 2 as T and the duty factor thereof is 50%, the pulse cycle period from the flip-flop circuit 3 is given as 2T and the duty factor thereof is also given as 50%. Therefore, the condition required for the delay time t2−t1 of the delay circuit 14 is t2−t1>2T as illustrated in FIG. 2(*g*). The delay time in this example of the delay circuit 14 corresponds to one ON interval of the switching transistors Q1 and Q2, however, further longer delay time can be employed, in that a delay period corresponding to a plurality of ON intervals can be employed.

With thus structured circuit transistors having a low withstand voltage can be used for the transistors Q1 and Q2, and further such transistors having a low withstand voltage used in the circuit according to the present embodiment are hardly broken.

In the above explained embodiment, the control circuit is designed to generate two system pulses having phase difference of 180° each other from the flip-flop circuit, however, such is merely an example. The present invention is not limited to the control circuit in which two system pulses are generated through inversion by the flip-flop circuit. A control circuit which generates one system pulse can be likely used. Further, the switching transistors are not limited to the N channel MOS transistors, but P channel MOS transistors can be used therefor. In the same way the transistor in the switching circuit is not limited to the P channel MOS transistor, but an N channel MOS transistor can be used therefor. Further, in the present invention PNP or NPN bipolar transistors can be used for the P channel or N channel MOS transistors. However, when replacing a P channel MOS transistor for an N channel transistor or a PNP bipolar transistor for an NPN bipolar transistor, it is preferable to use a negative voltage of a power source.

Still further, in the present embodiment the driving of a cold cathode tube is exemplified, however, the the piezo electric transformer driving circuit can be, of course, used for other stepping-up circuits.

We claim:

1. A piezo electric transformer driving circuit comprising a series circuit including a switch circuit, a coil and a switching transistor and being connected successively in the named order between a power source line and a ground; a piezo electric transformer of which primary side electrode is connected to a juncture of said coil and said switching transistor; and a drive halting circuit which geneates a first control signal for turning OFF said switch circuit and further generates a second control signal for halting a switching operation of said switching transistor after a predetermined period from the generation of the first control signal, wherein the predetermined period is at least one turned ON interval of said switching transistor and through the switching operation of said switching transistor, a high voltage is generated at a secondary side of said piezo electric transformer.

2. A piezo electric transformer driving circuit according to claim 1, wherein said coil serves as a first coil and said switching transistor serves as a first switching transistor, and another series circuit including a second coil and a second switching transistor and being disposed in parallel with the series circuit including said first coil and said first switching transistor, and the predetermined period corresponds to a period including at least one ON interval of said respective first and second switching transistors.

3. A piezo electric transformer driving circuit according to claim 2, further comprising a flip-flop circuit, and wherein said piezo electric transformer includes two primary side electrodes, one of said first and second switching transistors is switched in response to a Q output from said flip-flop circuit, the other of said first and second switching transistors is switched in response to an inverted side output generated with the Q output of said flip-flop circuit, one of the two primary side electrodes receives an output from said first switching transistor, the other of the two primary side electrodes receives an output from said second switching transistor, and the second control signal operates to halt the operation of said flip-flop circuit.

4. A piezo electric transformer driving circuit according to claim 3, further comprising a pulse oscillation circuit and a delay circuit, and wherein said flip-flop circuit receives an output pulse from said pulse oscillation circuit and generates the Q output and the inverted side output, the second control signal is generated by delaying the first control signal through said delay circuit, and said drive halting circuit generates the first control signal when a predetermined manipulation switch such as a power source switch and a switch for halting the driving circuit is manipulated.

5. A piezo electric transformer driving circuit according to claim 4, wherein a duty factor of the output pulse is substantially 50%, the delay time with said delay circuit is twice longer than the cycle interval of the output pulse, said first and second switching transistors are N channel MOSFET transistors, said switch circuit has a P channel MOSFET transistor and inductance values of said first and second coils are respectively selected in view of the capacitive component of said piezo electric transformer so as to resonate with the switching frequency of said first and second switching transistors.

6. A cold cathode tube illuminating device comprising a series circuit including a switch circuit, a coil and a switching transistor and being connected successively in the named order between a power source line and a ground; a piezo electric transformer of which primary side electrode is connected to a juncture of said coil and said switching transistor; a drive halting circuit which geneates a first control signal for turning OFF said switch circuit and further generates a second control signal for halting a switching operation of said switching transistor after a predetermined period from the generation of the first control signal; and a cold cathode tube connected to a secondary electrode of said piezo electric transformer, wherein the predetermined period is at least one turned ON interval of said switching transistor and through the switching operation of said switching transistor, said cold cathode tube is lighted on.

7. A cold cathode tube illuminating device according to claim 6, wherein said coil serves as a first coil and said switching transistor serves as a first switching transistor, and another series circuit including a second coil and a second switching transistor and being disposed in parallel with the series circuit including said first coil and said first switching transistor, the predetermined period corresponds to a period including at least one ON interval of said respective first and second switching transistors and said cold cathode tube is used as a back light for a liquid crystal display device.

8. A cold cathode tube illuminating device according to claim 7, further comprising a flip-flop circuit, and wherein said piezo electric transformer includes two primary side electrodes, one of said first and second switching transistors is switched in response to a Q output from said flip-flop circuit, the other of said first and second switching transistors is switched in response to an inverted side output generated with the Q output of said flip-flop circuit, one of the two primary side electrodes receives an output from said first switching transistor, the other of the two primary side electrodes receives an output from said second switching transistor, and the second control signal operates to halt the operation of said flip-flop circuit.

9. A cold cathode tube illuminating device according to claim 8, further comprising a pulse oscillation circuit and a delay circuit, and wherein said flip-flop circuit receives an output pulse from said pulse oscillation circuit and generates the Q output and the inverted side output, the second control signal is generated by delaying the first control signal through said delay circuit, and said drive halting circuit generates the first control signal when a predetermined manipulation switch such as a power source switch, a switch for lighting off said cold cathode tube and a switch for halting the driving operation of said piezo electric transformer is manipulated.

10. A cold cathode tube illuminating device according to claim 9, wherein a duty factor of the output pulse is substantially 50%, the delay time with said delay circuit is twice longer than the cycle interval of the output pulse, said first and second switching transistors are N channel MOSFET transistors, said switch circuit has a P channel MOSFET transistor and inductance values of said first and second coils are respectively selected in view of the capacitive component of said piezo electric transformer so as to resonate with the switching frequency of said first and second switching transistors.

* * * * *